US007387991B2

(12) United States Patent
Hudson

(10) Patent No.: US 7,387,991 B2
(45) Date of Patent: Jun. 17, 2008

(54) MICROEMULSIONS CONTAINING ALKOXYLATED AMINE CARBOXYLATES

(76) Inventor: Alice P. Hudson, 1303 Park La. South, Jupiter, FL (US) 33458

( * ) Notice: Subject to any disclaimer, the term of this patent is extended or adjusted under 35 U.S.C. 154(b) by 50 days.

(21) Appl. No.: 11/245,263

(22) Filed: Oct. 7, 2005

(65) Prior Publication Data

US 2007/0082834 A1 Apr. 12, 2007

(51) Int. Cl.
*C11D 1/62* (2006.01)
*C11D 7/08* (2006.01)
*C11D 3/43* (2006.01)

(52) U.S. Cl. ..... 510/417; 510/365; 510/271; 510/269; 510/245; 510/243; 510/119; 510/123; 510/124; 510/238; 510/239; 510/432; 510/463; 510/504

(58) Field of Classification Search ..... 510/417, 510/119, 123, 124, 238, 239, 243, 245, 269, 510/271, 365, 432, 463, 504
See application file for complete search history.

(56) References Cited

U.S. PATENT DOCUMENTS 3,811,830 A * 5/1974 DeMarco ..... 8/405
3,867,162 A * 2/1975 Elste, Jr. ..... 106/277
4,517,025 A * 5/1985 Plante et al. ..... 134/38
4,540,442 A * 9/1985 Smith et al. ..... 134/2
5,019,376 A * 5/1991 Uick ..... 424/70.28
5,238,731 A * 8/1993 Blanch et al. ..... 442/99
5,441,654 A * 8/1995 Rossio ..... 508/527
5,945,026 A * 8/1999 Thames ..... 252/8.05
6,139,775 A * 10/2000 Thames ..... 435/262.5
6,187,737 B1 * 2/2001 Geke et al. ..... 510/245
6,428,902 B1 * 8/2002 Amundson et al. ..... 428/532

* cited by examiner

*Primary Examiner*—Charles I Boyer

(57) ABSTRACT

The compositions of this invention are microemulsions having a. a surfactant consisting essentially of a mixture of one or more alkoxylated amines or alkoxylated quaternary ammonium salts and one or more preferably branched carboxylic acids or salts thereof, b. a solvent or oil that is liquid at 25° C. and is insoluble in water, and c. water, wherein an optically clear isotropic microemulsion is formed.

13 Claims, No Drawings

MICROEMULSIONS CONTAINING ALKOXYLATED AMINE CARBOXYLATES

FIELD OF THE INVENTION

This invention is to optically clear isotropic microemulsion compositions, useful in cleaning and related applications, wherein the emulsifier is a surfactant comprising a mixture of one or more alkoxylated amines or alkoxylated quaternary ammonium salts, and one or more carboxylic acids or carboxylate salts, which are preferably branched. The microemulsions do not require a cosurfactant.

BACKGROUND OF THE INVENTION

Microemulsions are useful as compositions that combine the solvency or other desired activity of a solvent or oil phase with the detergency or other desired activity of the surfactants and other components of an aqueous phase. They are optically clear, thermodynamically stable compositions typically comprising water insoluble or sparingly soluble liquid solvents or oils, surfactants or mixtures thereof, various cosurfactants, and water. The cosurfactants can be low molecular weight alcohols containing 2 to 10 carbon atoms, mono or polyglycols, glycol ethers, cyclic ketones, and the like. The purpose of adding the cosurfactants to the formulations is to decrease the interfacial tension between the aqueous phase and the insoluble solvent or oil phase so that the composition becomes a thermodynamically stable mixture of bicontinuous phases. These cosurfactants typically have moderate to high volatility, which may add to the volatile organic compound (VOC) content of formulations and thus may restrict their applications, and also may add distinctive and often objectionable odors. The microemulsion formulations may also contain other components such as detergent builders, alkalies, viscosifying agents, dyes and perfumes commonly found in detergent formulations.

Many microemulsion compositions are known. Examples include U.S. Pat. Nos. 6,824,623, 6,244,685, 5,990,072, and 5,952,287, which describe compositions containing alkyl esters as the oil phase, and various surfactants and other ingredients, all requiring the use of a cosurfactant. Further examples are U.S. Pat. Nos. 5,717,925, 5,616,548, 5,108,643, 5,082,584, and WO2004/07887, which describe microemulsions with a range of insoluble oils and surfactant systems. These compositions and other compositions of the prior art require the use of cosurfactants in their formulation.

Ethoxylated amines and ethoxylated quaternary ammonium salts have been shown to have detergent properties in specific applications, and are occasionally used in detergent compositions. Ethoxylated amines are described in U.S. Pat. Nos. 6,080,713, 5,719,118, and 5,616,811, incorporated herein by reference.

Fatty acid soaps usually derived from natural oils and fats have been widely used as surfactants in detergent and cleaner formulations since antiquity. Soaps of oleic and linoleic acid have been shown to have utility in forming microemulsions, for example in U.S. Pat. No. 5,990,072. They require the use of a cosurfactant to form clear microemulsions.

The use of mixtures of anionic and cationic surfactants is usually avoided because the mixtures tend to form precipitates in aqueous systems. However, it is known that these mixtures may have beneficial surfactant properties if they are properly formulated, due to the property of having very low surface and interfacial tension. U.S. Pat. No. 6,617,303 describes mixtures of ethoxylated fatty amines with anionic surfactants, including ether carboxylates. GB Patent No. 2,195,653 describes complexes of ethoxylated amines and higher alkyl fatty acids as emulsifiers for fabric softener quaternary ammonium salt-anionic surfactant complexes. U.S. Pat. No. 5,622,554 describes asphalt compositions containing ether amine salts of carboxylic acids. U.S. Pat. No. 6,169,064 describes mixtures of alkyl polyether carboxylates and ether arnines or alkyl amines. U.S. Pat. No. 4,472,291 discloses microemulsions formed from charged primary surfactants, cosurfactants, and a secondary surfactant that is oppositely but not highly charged, added to increase the viscosity. EP Patent No. 0160762 discloses microemulsion compositions wherein a nitrogen-containing compound is added to a fatty acid soap containing formulation to provide pH stability. U.S. Pat. No. 5,298,193 describes mixtures of nonionic surfactants with an anionic surfactant and a cationic surfactant. In the '193 patent alkoxylated amines are described as nonionic surfactants, and can be used to stabilize the anionic-cationic complexes.

Mixtures of ethoxylated tallow amine and branched acids are disclosed in U.S. Pat. Nos. 5,945,026, 6,139,775, 6,740,250, and US Pub. No. 2003/001057. These compositions contain cosurfactant alcohols and are used as concentrates for firefighting solutions.

Mixtures of saturated carboxylic acids, which may be branched, and ether amines are disclosed in US Pub. No. 2004/0010967. They are useful as friction modifiers for combustible fuels.

It is an object of this invention to provide highly efficient surfactants for preparing microemulsions.

It is a further object to form microemulsions without the use of cosurfactants, which often add VOC's and objectionable odors.

It is a further object to provide compositions that are isotropic liquids over broad ranges of water content.

It is a further object to provide stable microemulsions that can be formulated with other surfactants, builders, and components common to cleaning formulations without destroying the microemulsion.

SUMMARY OF THE INVENTION

The compositions of this invention are microemulsions comprised of a. a surfactant which is a mixture of one or more alkoxylated amines or alkoxylated quaternary ammonium salts and one or more preferably branched carboxylic acids, or salts thereof, b. a solvent or oil that is liquid at 25° C. and is insoluble in water, and c. water, wherein an optically clear isotropic microemulsion is formed.

The alkoxylated amines are chosen from the group consisting of

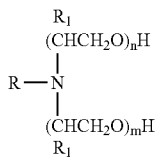

wherein R is straight or branched alkyl or alkenyl containing from about 6 to 18 carbon atoms or is $R_2$—O—$R_3$— wherein $R_2$ is straight or branched alkyl or alkenyl containing from about 6 to 18 carbon atoms and $R_3$ is alkylene containing 2 to 6 carbon atoms or is polyyalkyleneoxy containing about 1 to 3 ethyleneoxy or propyleneoxy groups, $R_1$ is H or —$CH_3$, n and m are each from about 1 to 19 and n+m is from about 2 to 20.

The alkoxylated quaternary ammonium salts are chosen from the group consisting of

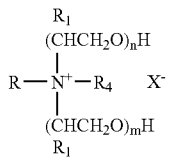

wherein R, $R_1$, n, and m are defined as above, $R_4$ is ethyl or methyl, and $X^-$ is chloride, bromide, iodide, methosulfate, ethosulfate, sulfate, nitrate, or acetate.

The carboxylic acids or carboxylate salts are chosen from the group consisting of $R_5$—COOM wherein $R_5$ is an aliphatic or olefinic hydrocarbyl group that is preferably branched or cyclic with from about 4 to about 17 carbon atoms, and M is $H_+$, alkali metal cation, ammonium, or mono, di, or trialkanolammonium.

The molar ratio of alkoxylated amine or alkoxylated quaternary ammonium salt or combinations thereof to carboxylic acid is from about 0.5 to 1 to about 2 to 1.

Without wishing to be bound by theory it is believed that the carboxylic acids of this invention form organic salts or complexes with the alkoxylated amines and quaternary ammonium salts resulting from the polar and electrostatic interactions between the predominantly positively charged amine or ammonium moieties and the predominantly negatively charged carboxylate groups. The alkoxylate or polyalkoxylate moieties solubilize the complex and prevent formation of insoluble precipitates in aqueous systems. The preferred branched alkyl portion of the acids prevent the formation of lamellar or liquid crystalline structures with the insoluble solvent or oil in the microemulsions and thus reduce or eliminate the formation of gelled or liquid crystalline phases. It is surprising that these compositions are highly efficient microemulsifiers by themselves; the addition of traditional cosurfactants is unnecessary and often destabilizes the microemulsions.

DESCRIPTION OF THE PREFERRED EMBODIMENTS

The compositions of this invention are microemulsions comprised of a. a surfactant consisting of a mixture of one or more alkoxylated amines or alkoxylated quaternary ammonium salts and one or more preferably branched carboxylic acids carboxylate salts, b. a solvent or oil that is liquid at 25° C. and is insoluble in water, and c. water, wherein an optically clear isotropic microemulsion is formed.

The alkoxylated amines are chosen from the group consisting of:

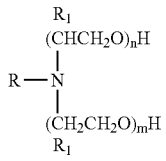

wherein R is straight or branched alkyl or alkenyl containing from about 6 to 18 carbon atoms or is $R_2$—O—$R_3$— wherein $R_2$ is straight or branched alkyl or alkenyl containing from about 6 to 18 carbon atoms and $R_3$ is alkylene containing 2 to 6 carbon atoms or is polyoxyalkylene containing about 1 to 3 ethyleneoxy or propyleneoxy groups, $R_1$ is H or —$CH_3$, n and m are from about 1 to 19 and n+m is from about 2 to 20.

Examples of suitable alkoxylated amines include cocoamine condensed with from about 2 to 20 moles of ethylene oxide, and preferably 5 to 10 moles of ethylene oxide. Available products are Ethomeens C/12, C/15, C/20 and C/25 which are 2, 5, 10 and 15 mole ethoxylates from AKZO, Chicago, Ill.; Chemeens C-2, C-5, C-10, C-12, and C-15, which are 2, 5, 10, 12, and 15 mole ethoxylates from Rutgers Organics (Chemax Performance Products), Piedmont, N.C.; and Ethox CAM-2, CAM-5, and CAM-15, which are 2, 5, and 15 mole ethoxylates from Ethox Chemicals, Greenville, S.C. Tallow amine ethoxylates condensed with from 2 to 20 moles of ethylene oxide and preferably 5 to 10 moles of ethylene oxide, are available as Ethomeens T/12, T/15, and T/25 which are 2, 5, and 15 mole ethoxylates from AKZO; Chemeens T-2, T-5, T-10, T-15, and T-20 which are 2, 5, 10, 15, and 20 mole ethoxylates from Rutgers Organics; and Ethox TAM-2 TAM-5, TAM-8, TAM-15, and TAM-20 which are 2, 5, 8, 15, and 20 mole ethoxylates from Ethox Chemicals. Ethoxylated soya amines are also available as Ethomeens S/12, S/15, S/20, and S/25 which are 2, 5, 10, and 15 mole ethoxylates from AKZO; and Chemeen S-5 which is a 5 mole ethoxylate from Rutgers Organics. A 2 mole ethoxylated oleyl amine is available as Chemeen O-2 from Rutgers Organics. Ethoxylated stearyl amines are available as Ethomeens 18/12, 18/15, 18/20, and 18/25, which are 2, 5, 10, and 15 mole ethoxylates from AKZO; Chemeens HT-5, HT-6, HT-8, and HT-15 which are 5, 6, 8, and 15 mole ethoxylates from Rutgers Organics; and Ethox SAM-2 and SAM-10 which are 2 and 10 mole ethoxylates from Ethox Chemicals. The ethoxylated stearyl amines may form gelled structures over some concentration ranges and therefore are less preferred. Ethoxylated branched C12-14 alkyl amines in which the amine is attached to a tertiary carbon are available as Tritons RW-20, RW-30, RW-50, RW-75, RW-100, RW-125, and RW-150 which are 2, 3, 5, 7.5, 10, 12.5, and 15 mole ethoxylates from Dow Chemical, Midland, Mich. The Triton products provide very low foaming compositions and may be used when this is required. Ethoxylated alkyl ether amines are available from Tomah Products, Inc., Milton, Wis. Isodecyloxypropylamine condensed with 2 and with 5 moles of ethylene oxide are available as Tomah E-14-2, and E-14-5. Tridecyloxypropyl amine condensed with 2 and with 5 moles of ethylene oxide are available as Tomah E-17-2 and E-17-5, and stearyloxypropylamine condensed with 2, 5, and 15 moles of ethylene oxide are available as E-18-2, E-18-5, and E-18-15. Also useful in this invention are experimental surfactants from Huntsman, Houston, Tex., which are $C_{10-12}$ alcohols condensed with 2 moles of propylene oxide in which the terminal hydroxyl is converted to a primary amine and condensed with ethylene oxide, designated M-302, M-305, M-310, M-315, and M-320, which are 2, 5, 10, 15, and 20 mole ethoxylates. Propoxylated amines include Propomeen C/12 which is cocoamine condensed with 2 moles of propylene oxide available from AKZO. Mixtures of alkoxylated amines are also suitable. One skilled in the art will recognize that other alkoxylated amine structures may be appropriate and are included in the invention. Ethoxylated cocoamines provide excellent emulsification and high foam, and are highly suitable. The 5 mole ethoxylate is especially preferred. Ethoxylated isoalkyloxypropyl amines provide lower foam characteristics, and are preferred in applications requiring low foam. The 5 mole ethoxylate of isodecyloxypropyl amine is useful for these applications.

The alkoxylated quaternary ammonium salts are chosen from the group consisting of

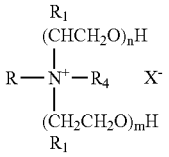

wherein R, $R_1$, n, and m are defined as above, $R_4$ is ethyl or methyl, and $X^-$ is chloride, bromide, iodide, methosulfate, ethosulfate, sulfate, nitrate, or acetate.

Examples of suitable alkoxylated quaternary ammonium salts include Ethoquads 18/12 and 18/25 which are octadecyl methyl 2 and 5 mole ethoxylated ammonium chlorides, Ethoquads C/12 and C/25 which are cocomethyl 2 and 5 mole ethoxylated ammonium chlorides, and Ethoquads O/12 and O/25 which are oleylmethyl 2 and 5 mole ethoxylated ammonium chlorides, available from AKZO. Also available is Chemquat T20DES which is tallowethyl 20 mole ethoxylated ammonium ethosulfate, available from Rutgers Organics. Quaternized ethoxylated ether amines are available from Tomah Products. Tomah Q-17-2 is the quaternary ammonium salt from the condensation of Tomah E-17-2 (described above) with methyl chloride, and Tomah Q-18-5 is the quaternary ammonium salt from the condensation of Tomah E-18-5 (described above) and methyl chloride. Mixtures of alkoxylated quaternary ammonium salts are also suitable. One skilled in the art will recognize that other alkoxylated quaternary ammonium structures may be appropriate and are included in the invention.

The carboxylic acids of this invention are chosen from the group consisting of

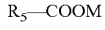

wherein $R_5$ is an aliphatic or olefinic preferably branched or cyclic hydrocarbyl group with from about 4 to about 17 carbon atoms, and M is $H^+$, alkali metal cation, ammonium, or mono, di, or trialkanolammonium.

Suitable carboxylic acids include:

1. Isoacids of the structure:

wherein $R_a$ is a hydrocarbyl group containing from about 3 to about 12 carbon atoms including at least one substituted methyl group on other than the terminal carbon atom. Commercially available isoacids are usually mixtures of isomers, which differ in the number and position of the methyl substitutions. Suitable available isoacids include isopentanoic acid, isoheptanoic acid, isooctanoic acid, isononanoic acid, isodecanoic acid, and isotridecanoic acid. A product known as isostearic acid, which is a byproduct of the production of dimer acids from tall oil, and is an 18 carbon branched fatty acid of undetermined structure, may also be used.

2. Neoacids. These are synthesized by reacting under high pressure and at elevated temperature a branched olefin and high-purity carbon monoxide in the presence of an acidic catalyst and water. The resulting acids have a tertiary carbon adjacent to the carboxyl group and are mixtures of isomers of the structure:

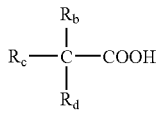

wherein $R_b$, $R_c$, and $R_d$ are each alkyl radicals containing 1 to about 10 carbon atoms, with the total number of carbon atoms contained in $R_b$, $R_c$, and $R_d$ being from about 3 to about 12.

Neoacids with 7 or more carbon atoms are mixtures of isomers. For example, the typical isomer distribution of neodecanoic acid is: $R_b$ and $R_c$ are methyl, $R_d$ is $C_6$, 31%; $R_b$ is methyl, $R_c$ and $R_d$ are $C_2$ to $C_5$, 67%; $R_b$ is $C_2$, $R_c$ and $R_d$ are $C_2$ or $C_3$, 2%. Readily available and suitable neoacids include neopentanoic acid, neoheptanoic acid, neooctanoic acid, neononanoic acid, neodecanoic acid, and neotridecanoic acid.

3. Naphthenic acids. As used herein, this term means the generic designation of monocarboxylic acids of naphthene hydrocarbons, present in crude mineral oils, which acids have the formula $R_e(CH_2)_nCOOH$, wherein $R_e$ is a cyclic nucleus composed of one or more rings, i.e., cyclohexane, cyclopentane, and their alkylated cyclic nuclei, in general, and n is an integer from 1 to about 14. The carboxylic acid group combines with the ring nucleus ($R_e$) through methylene $(—CH_2—)_n$ groups. The simplest and typical acid, when n=1, is cyclopentane acetic acid.

Commercial naphthenic acids suitable for use in this invention are mixtures of inseparable organic acids having from 7 to about 18 carbon atoms and a cyclic nucleus. Accordingly, the naphthenic acid is used as a mixture of substances having the formula given above, and may also contain a minor amount of upsaponifiable material, which is unspecified but usually hydrocarbon in nature. Preferred naphthenic acids have equivalent weights per carboxylic acid functionality of less than about 300, and more preferred naphthenic acids have equivalent weights less than about 250.

4. Guerbet acids, obtained from Guerbet alcohols, of the structure:

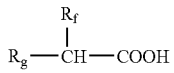

wherein $R_f$ is a hydrocarbyl group containing from about 2 to about 6 carbon atoms, and $R_g$ is a hydrocarbyl group containing from about 4 to about 8 carbon atoms, and $R_f$ always contains exactly 2 carbon atoms less than $R_g$. Available and suitable Guerbet acids include 2-ethylhexanoic acid, 2-butyloctanoic acid, and 2-hexyldecanoic acid. 2-ethylhaxanoic acid is readily available and can be used to form compositions with lower foaming properties.

5. Straight chain aliphatic or olefinic fatty acids with from about 6 to about 10 carbon atoms. Available and suitable acids are n-hexanoic acid, n-heptanoic acid, n-octanoic acid, n-nonanoic acid, and n-decanoic acid.

Acids which provide excellent emulsification properties and form isotropic microemulsions over broad concentration ranges are branched and contain from about 7 to about 12 carbon atoms. Especially preferred acids include isononanoic acid, neodecanoic acid and 2-ethylhexanoic acid.

The insoluble solvents or oils are chosen from those that are appropriate for the cleaning applications for which the formulation is intended. D'limonene, which is a terpene hydrocarbon obtained from citrus byproducts, and solvents that contain a major portion of d'limonene such as orange oil are widely used in both consumer products and industrial cleaning products and are highly suitable. Other terpene and terpenoid materials which can be derived from turpentine, particularly pine oil, which is a mixture of terpene hydrocarbons, terpene alcohols and terpene esters, and is a common agent used in many household cleaners, disinfectants and deodorants, may also be used. Paraffin solvents with boiling points above 100° C. are also commonly used in household and industrial cleaners and are highly suitable. Normal paraffins with from about 8 to 16 carbon atoms are suitable. Preferred over normal paraffins because they are liquid at higher molecular weights are isoparaffins, for example those sold by Exxon Mobil, Houston, Tex., as Isopars E, G, H, K, L, M, and V. Hydrocarbons sold as mineral spirits, which are refined petroleum distillates containing paraffinic and naphthenic hydrocarbons with boiling points in the range of about 150° C. to 200° C. are also suitable. Alkyl aromatic hydrocarbons with about 9 to 18 total carbon atoms have good solvency and are also useful. Olefins with boiling points over 100° C. containing about 10 to 20 carbon atoms are also included. Ester solvents are also suitable. Included are $C_1$ to $C_8$ alkyl esters of fatty acids containing from about 6 to 20 carbon atoms. Available and useful esters include methyl esters of mixtures of predominantly unsaturated $C_{12}$ to $C_{20}$ fatty acids derived from vegetable oils including soya, canola, rapeseed, corn, cottonseed, sunflower seed, linseed, coconut, palm, palm kernel and fractions thereof. Methyl soyate, known as biodiesel, is readily available and provides excellent solvency for tarry residues. A mixture of $C_8$ and $C_{10}$ fatty acid methyl esters sold by Cognis, Cincinnati, Ohio, as Emery 2207 provides acrylic resin solvency for graffiti removal. Also available and useful are acetate esters of hydrocarbon alcohols with from about 6 to 20 carbon atoms. Examples of these esters are Exxates 600, 700, 800, 900, 1000, and 1300, which are the hexyl, heptyl, octyl, nonyl, decyl, and tridecyl acetates available from Exxon Mobil. Diesters are also useful. Examples are dimethyl esters of succinic, glutaric, adipic, suberic, azeleic, and sebacic acids, and mixtures thereof, and di-$C_1$ to $C_8$ esters of phthalic acids. The invention is not limited to the solvents described above; one skilled in the art will recognize that many other solvents may be appropriate.

It will also be recognized that other components that are soluble in the solvent or oil can be added to or substituted for the solvent or oil phase to achieve specific objectives. Examples include perfumes, adjuvants such as the mosquito repellant N, N-diethyl-m-toluamide (DEET), animal repellants such as 2-undecanone, oil soluble dyes, and the like.

To minimize hazards from flammability, solvents with flash points above about 50° C. are preferred. To minimize toxicity and adverse environmental effects, nonhalogenated solvents are preferred. Terpenes, particularly d'limonene, and fatty acid methyl esters are especially preferred.

The microemulsions of this invention are compatible with a broad range of surfactants, alkaline materials, builders, salts, dyes and perfumes, and other components that are commonly used in cleaning compositions, and these components may be added to the microemulsions to provide added benefits.

Surfactants:

Surfactants may be added to provide additional detersive or other desired performance attributes and may be added at the concentrations required for the application. The surfactants described herein are presented as examples only, and do not represent an exhaustive list of those that might be used and are included in this invention. Compatible surfactants include anionic surfactants such as alkyl aryl sulfonates, olefin sulfonates, paraffin sulfonates, alcohol sulfates, alcohol ether sulfates, alkyl carboxylates and alkyl ether carboxylates, and alkyl and ethoxylated alkyl phosphate esters, and mono and dialky sulfosuccinates and sulfosuccinamates. Cationic surfactants, which may be added, include alkyl trimethyl quaternary ammonium salts, alkyl dimethyl benzyl quaternary ammonium salts, dialkyl dimethyl quaternary ammonium salts, and imidazolinium salts. Nonionic surfactants include alcohol alkoxylates, alkylphenol alkoxylates, block copolymers of ethylene, propylene and butylene oxides, alkyl dimethyl amine oxides, alkyl-bis(2-hydroxyethyl) amine oxides, alkyl amidopropyl dimethyl amine oxides, alkylamidopropyl-bis(2-hydroxyethyl) amine oxides, alkyl polyglucosides, polyalkoxylated glycerides, sorbitan esters and polyalkoxylated sorbitan esters, and alkoyl polyethylene glycol esters and diesters. Also included are betaines and sultanes, amphoteric surfactants such as alkyl amphoacetates and amphodiacetates, alkyl amphopropripionates and amphodipropionates, and alkyliminodiproprionate. Mixtures of surfactants may also be added.

Salts, alkaline materials, and builders:

The microemulsions of this invention are highly compatible with a broad range of adjuvants such as inorganic and carboxylate salts, detergent builder materials, and alkaline materials characterized by being water soluble and ionic or highly polar in nature, added to provide hard water tolerance, improved detergency, and other benefits. The addition of many of these materials actually improves the efficacy of the amine carboxylate surfactant of this invention in forming the microemulsions. The materials described herein are presented as examples only and do not represent an exhaustive list of those that might be used and are included in this invention. Neutral inorganic salts such as alkali, alkaline earth or ammonium salts of hydrochloric, sulfuric, nitric, phosphoric, boric, acetic, and glycolic acids may be added to improve the microemulsion or for other effects specific to the salt composition. Materials characterized as detergent builders such as the sodium, potassium, or ammonium tripolyphosphates, pyrophosphates, citrates, nitrilotriacetates, ethylenediamine tetraacetates, polyacrylates, and the like may provide improved hard water tolerance and cleaning performance. Alkaline materials, such as alkali metal or ammonium hydroxides, alkali metal silicates, alkali metal carbonates, mono, di, and trialkanolamines may be added to provide alkaline pH values and improved detergency. Mixtures of these materials may also be used.

The alkoxylated amine or quaternary ammonium salt carboxylate salts or complexes of this invention are formed by simply mixing the amines of this invention or salts thereof, or the quaternary ammonium salts of this invention, with the carboxylic acids of this invention or salts thereof. The complexes or salts are conveniently and preferably prepared by simply mixing the components under ambient conditions. They can be prepared as anhydrous mixtures or can be prepared as solutions in water. The components can be warmed to facilitate mixing. The molar ratio of amine or quaternary ammonium salt to carboxylic acid can be from about 0.5 to about 2, and the preferred ratio is from about 0.75 to about 1.5. Especially preferred ratios are from about 1 to about 1.25. Preferred compositions prepared from cocoamine or isodecyloxypropyl amine condensed with about 5 moles of ethylene oxide and a branched acid or mixture of branched acids containing from about 7 to about 10 carbon atoms are miscible in water and are pourable liquids in all proportions of surfactant and water.

The microemulsions of this invention are formed by methods known in the art. Because the preferred isotropic microemulsions are thermodynamically stable, they will form spontaneously on mixing the amine or quaternary ammonium carboxylate complex surfactant, either preformed or formed in situ, solvent or oil, and water components with adequate agitation. They can be prepared in dilute form containing from about 0.1 to 5 percent by weight solvent for ready to use cleaners such as household cleaner-degreasers. They can be prepared in more concentrated formulations containing from about 5 to 50 percent by weight or more solvent for applications such as industrial cleaning, stain removers for tar and asphalt and other difficult stains, or cleaners to be diluted into water. The dilutions may remain as microemulsions in the diluted form, or may "bloom", or become opaque or translucent macroemulsions on dilution. The weight ratio of the amine or quaternary ammonium carboxylate complex surfactant to the solvent or oil phase is determined by a number of factors including the desired water content, the components of the surfactant and of the solvent or oil phase, and the use application of the composition. If a concentrate which will bloom in the dilution, or a high oil phase cleaner is being formulated the weight ratio can be from about 1 to 5 to about 1 to 0.5. If a diluted cleaner, or a concentrate for which a clear dilution is required is being formulated the weight ratio of surfactant to oil is about 1 to 1.5 to about 1 to 0.1. Other components can be added as required; one skilled in formulating emulsion compositions will be aware of the conditions required.

The following examples further illustrate the invention. As used herein all parts or percentages are by weight unless otherwise indicated.

EXAMPLE 1

The organic salts or complexes described in Table 1 were formed by mixing the amines and acids described in equimolar quantities. Microemulsions were formed by mixing 3 g of the organic salts with 2 g of d'limonene, and adding water in increments and noting the appearance, until the mixture became cloudy indicating phase separation. The appearance when the compositions contained 25 percent by weight and 75 percent by weight water are noted in Table 1. When the surfactant is formed from propionic, benzoic, lauric, myristic and oleic acids, which are not compositions of this invention, the isotropic microemulsions of this invention do not form.

TABLE 1

| Amine | Acid | 25% water | 75% water |
|---|---|---|---|
| Isodecyl oxypropyl amine + 5 EO | 2-ethyl hexanoic | isotropic microemulsion | 2 phases |
| Cocoamine + 5 EO | isopentanoic | isotropic microemulsion | 2 phases |
| Cocoamine + 5 EO | 2-ethylhexanoic | isotropic microemulsion | isotropic microemulsion |
| Cocoamine + 5 EO | isononanoic | isotropic microemulsion | isotropic microemulsion |
| Cocoamine + 5 EO | pelargonic | liquid crystalline | isotropic microemulsion |
| Cocoamine + 5 EO | neodecanoic | isotropic microemulsion | isotropic microemulsion |
| Cocoamine + 5 EO | 2-butyloctanoic | isotropic microemulsion | 2 phases |
| Cocoamine + 5 EO | naphthenic acid, AN 250 | isotropic microemulsion | 2 phases |
| Cocoamine + 5 EO | isostearic acid | isotropic microemulsion | 2 phases |
| Cocoamine + 15 EO | isononanoic | isotropic microemulsion | 2 phases |
| Triton RW-50 | isononanoic | isotropic microemulsion | 2 phases |
| $C_{10-12}$ alkyloxy$(PO)_2$ amine + 10 EO | isononanoic | isotropic microemulsion | 2 phases |
| Mole/mole mix of $C_{10-12}$ Alkyloxy$(PO)_2$ amine + 2 EO and + 10 EO | isononanoic | isotropic microemulsion | isotropic microemulsion |
| Comparitive examples | | | |
| Cocoamine + 5 EO | propionic | liquid crystalline | 2 phases |
| Cocoamine + 5 EO | benzoic | liquid crystalline | 2 phases |
| Cocoamine + 5 EO | lauric | liquid crystalline | liquid crystalline |

TABLE 1-continued

| Amine | Acid | 25% water | 75% water |
|---|---|---|---|
| Cocoamine + 5 EO | myristic | liquid crystalline | 2 phases |
| Cocoamine + 5 EO | oleic | liquid crystalline | 2 phases |

EXAMPLE 2

An isotropic microemulsion with d'limonene as the oil phase was prepared from an equimolar mixture of an ethoxylated quaternary ammonium salt and sodium isononanoate, with the composition:

| | |
|---|---|
| Decyloxypropyl-bis(2-hydroxyethyl)methyl ammonium chloride | 15.8% |
| Sodium isononanoate | 8.1% |
| D'limonene | 14.4% |
| Water | q.s |

EXAMPLE 3

Cocoamine condensed with 5 moles of ethylene oxide and isononanoic acid were mixed in the molar ratios indicated in Table 2 and these mixtures were then mixed with d'limonene at the weight ratios indicated. Water was added in increments and appearance when the compositions contained 25 percent by weight and 75 percent by weight water was noted and is described in Table 2. The results show that microemulsions of this invention can be formed at molar ratios of amine to acid from about 0.5 to 2, and ratios between 1 and 1.25 are particularly efficacious.

TABLE 2

| Molar ratio of Cocoamine + 5 EO to | Wt. ratio of surfactant to | Appearance | |
|---|---|---|---|
| Isononanoic acid | d'limonene | 25% water | 75% water |
| 0.5 | 4:1 | isotropic microemulsion | 2 phases |
| 0.75 | 3:2 | isotropic microemulsion | 2 phases |
| 1.0 | 3:2 | isotropic microemulsion | isotropic microemulsion |
| 1.0 | 2:3 | isotropic microemulsion | isotropic microemulsion |
| 1.1 | 2:3 | isotropic microemulsion | isotropic microemulsion |
| 1.1 | 1.75:3.25 | isotropic microemulsion | isotropic microemulsion |
| 1.1 | 1.5:3.5 | isotropic microemulsion | 2 phases |
| 1.1 | 1:4 | 2 phases | 2 phases |
| 1.25 | 2:3 | isotropic microemulsion | isotropic microemulsion |
| 1.5 | 3:2 | isotropic microemulsion | isotropic microemulsion |
| 2.0 | 2:3 | isotropic microemulsion | 2 phases |

EXAMPLE 4

Microemulsions were prepared containing 6 percent by weight of the cocoamine +5 EO-isononanoic acid complex at a molar ratio of amine to acid of 1.1:1, and 4 percent by weight d'limonene, with the balance being water. Detergent components including other surfactants, builders, salts, and alkaline materials were added in the amounts indicated and the effects on the microemulsion were observed. Results are shown in Table 3. The results show that the compositions of this invention are compatible with a broad range of detergent components.

TABLE 3

| | Effect on microemulsion | |
|---|---|---|
| Additive | 2% by wt | 10% by wt. |
| Dodecyltrimethylammonium chloride | stable | separated |
| Coco betaine | stable | stable |
| $NaC_{14-16}$ alpha olefin sulfonate | stable | stable |
| Na coconut fatty acid soap | stable | stable |
| Cocoyl diethanolamide | stable | gelled |
| Coco-bis(2-hydroxyethyl) amine oxide | stable | stable |
| Tridecyl alcohol + 9 EO | stable | stable |
| Monoethanol amine | stable | stable |
| Sodium tripolyphosphate | stable | stable |
| Sodium metasilicate | stable | stable |
| Sodium hydroxide | stable | stable |
| Sodium chloride | stable | stable |

EXAMPLE 5

A mixture of cocoamine+5 EO and isononanoic acid at a molar ration of 1.1 amine to 1 acid (CAM-5 INA) was used to make the following compositions which are isotropic microemulsions:

| | | |
|---|---|---|
| A. | CAM-5 INA | 22% |
| | methyl soyate | 11% |
| | water | 67% |
| B. | CAM-5 INA | 42% |
| | dimethyl adipate | 28% |
| | water | 30% |
| C. | CAM-5 INA | 15% |
| | heptyl acetate | 10% |
| | water | 75% |
| D. | CAM-5 INA | 21% |
| | isoparaffin solvent, BP 181-196° C. | 9% |
| | water | 70% |
| E. | CAM-5 INA | 15% |
| | $C_{8-10}$ fatty acid methyl esters | 10% |
| | Water | 75% |

EXAMPLE 6

A microemulsion was prepared using an equimolar mix of tallow amine+5 EO and isononanoic acid as the emulsifier and methyl soyate as the oil phase, with the composition:

| | |
|---|---|
| Talllow amine + 5EO isononanoate | 24% |
| Methyl soyate | 6% |
| Water | 70% |

EXAMPLE 7

Hard surface cleaners were prepared with the compositions A and B:

| Component | A | B |
|---|---|---|
| Mole/mole mixture of cocoamine + 5 EO/isononanoic acid | 7.5% | 6.7% |
| Methyl soyate | 2.5% | |
| D'limonene | | 3.3% |
| Water | q.s. | q.s. |

The cleaners were tested by the method of ASTM D4488 A-5, "Standard Guide for Testing Cleaning Performance of Products Intended for Use on Resilient Flooring and Washable Walls" at a 1/10 dilution and at a 1/50 dilution. Seventy-five percent soil removal at the recommended use dilution is an excellent result. The results of the tests are shown below, and indicate the microemulsions are excellent hard surface cleaners.

| | Percent soil removal | |
|---|---|---|
| Dilution | A | B |
| 1/10 | 100 | 97 |
| 1/50 | 79 | 87 |

Composition A also completely removed an asphalt film from ceramic tile when the cleaning solution was allowed to stand on the soiled tile for two minutes and then lightly scrubbed with a sponge.

EXAMPLE 8

A composition containing 1.5% of a 1.1/1 molar mixture of cocoamine+5 EO/isononanoic acid 1.0% $C_{8-10}$ fatty acid methyl esters readily removed acrylic spray paint graffiti from ceramic surfaces. The solution was applied to the painted surface and allowed to stand for 5 minutes, then rinsed with a high pressure water stream.

EXAMPLE 9

A microemulsion prepared by mixing 2.0% 2-undecanone 3.0% Cocoamine+5 EO 2.48% water solution of sodium isononanoate (45%)

1.75% sodium chloride q.s. water can be sprayed on surfaces and is an effective animal repellant.

The invention can be embodied in other forms without departing from the spirit or essential attributes thereof. Reference should therefore be had to the following claims, rather than to the foregoing specification to determine the scope of the invention.

What is claimed is:

1. A microemulsion comprising a. a surfactant consisting essentially of a combination of i. one or more alkoxylated amines or alkoxylated quaternay ammonium salts or mixtures thereof, chosen from the group consisting of

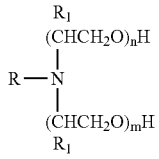

wherein R is straight or branched alkyl or alkenyl containing from about 6 to 18 carbon atoms or is $R_2$—O—$R_3$— wherein $R_2$ is straight or branched alkyl or alkenyl containing from about 6 to 18 carbon atoms and $R_3$ is alkylene containing about 2 to 6 carbon atoms or is polyyalkyleneoxy containing about 1 to 3 ethyleneoxy or propyleneoxy groups, $R_1$ is H or —$CH_3$, n and m are from about 1 to 19 and n+m is from about 2 to 20; and

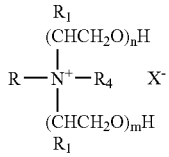

wherein R, $R_1$, n, and m are defined as above, $R_4$ is ethyl or methyl, and $X^-$ is chloride, bromide, iodide, methosulfate, ethosulfate, sulfate, nitrate, or acetate; and ii. one or more carboxylic acids or salts thereof, or mixtures thereof, chosen from the group consisting of $R_5$—COOM wherein $R_5$ is an aliphatic or olefinic branched or cyclic hydrocarbyl group with from about 4 to about 17 carbon atoms, or is a straight chain aliphatic or olefinic hydrocarbyl group with from about 5 to about 9 carbon atoms, and M is $H^+$, alkali metal cation, ammonium, or mono, di, or trialkanolammonium;

wherein the molar ratio of alkoxylated amine or alkoxylated quaternary ammonium salt or mixtures thereof to organic acid is from about 0.5 to 1 to about 2 to 1; and b. at least one solvent or oil that is liquid at 25° C. and is essentially insoluble in water, or a mixture of said solvents or oils, chosen from the group consisting of terpenes, terpene alcohols, terpene esters, hydrocarbon solvents, and ester solvents; and c. water.

2. The process of producing a microemulsion comprising mixing together:

a. a surfactant consisting essentially of a combination of i. one or more alkoxylated amines or alkoxylated quaternary ammonium salts or mixtures thereof, chosen from the group consisting of

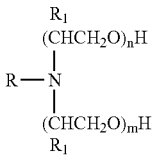

wherein R is straight or branched alkyl or alkenyl containing from about 6 to 18 carbon atoms or is $R_2$—O—$R_3$— wherein $R_2$ is straight or branched alkyl or alkenyl containing from about 6 to 18 carbon atoms and $R_3$ is alkylene containing about 2 to 6 carbon atoms or is polyyalkyleneoxy containing about 1 to 3 ethyleneoxy or propyleneoxy groups, $R_1$ is H or —$CH_3$, n and m are from about 1 to 19 and n+m is from about 2 to 20; and

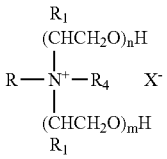

wherein R, $R_1$, n, and m are defined as above, $R_4$ is ethyl or methyl, and $X^-$ is chloride, bromide, iodide, methosulfate, ethosulfate, sulfate, nitrate, or acetate; and ii. one or more carboxylic acids or salts thereof, or mixtures thereof, chosen from the group consisting of $R_5$—COOM wherein $R_5$ is an aliphatic or olefinic branched or cyclic hydrocarbyl group with from about 4 to about 17 carbon atoms, or is a straight chain aliphatic or olefinic hydrocarbyl group with from about 5 to about 9 carbon atoms, and M is $H^+$, alkali metal cation, ammonium, or mono, di, or trialkanolammonium;

wherein the molar ratio of alkoxylated amine or alkoxylated quaternary ammonium salt or mixtures thereof to organic acid is from about 0.5 to 1 to about 2 to 1; and b. at least one solvent or oil that is liquid at 25° C. and is essentially insoluble in water, or a mixture of said solvents or oils, chosen from the group consisting of terpenes, terpene alcohols, terpene esters, hydrocarbon solvents, and ester solvents; and c. water.

3. The composition of claim 1 comprising an alkoxylated amine.

4. The composition of claim 1 wherein the solvent comprises d-limonene.

5. The composition of claim 1 wherein the solvent comprises a fatty acid methyl ester.

6. The composition of claim 3 wherein the solvent comprises d-limonene.

7. The composition of claim 3 wherein the solvent comprises a fatty acid methyl ester.

8. The composition of claim 1 wherein the amine is condensed with about 5 moles of ethylene oxide and the acid is aliphatic containing about 6 to about 12 carbon atoms.

9. The composition of claim 3 wherein the amine is condensed with about 5 moles of ethylene oxide and the acid is aliphatic containing about 6 to about 12 carbon atoms.

10. The composition of claim 1 wherein the amine is cocoamine condensed with about 5 moles of ethylene oxide and the acid is isononanoic acid.

11. The composition of claim 4 wherein the amine is cocoamine condensed with about 5 moles of ethylene oxide and the acid is isononanoic acid.

12. The composition of claim 1 wherein the weight ratio of the surfactant to the solvent or oil is from about 1:5 to about 1 to 0.5, and the oil or solvent comprises from about 5 to about 50 percent by weight of the total composition.

13. The composition of claim 1 wherein the weight ratio of the surfactant to the solvent or oil is from about 1:1.5 to about 1 to 0.1, and the oil or solvent comprises from about 0.1 to about 5 percent by weight of the total composition.

* * * * *